United States Patent [19]

Platt

[11] 3,987,508

[45] Oct. 26, 1976

[54] METHOD OF WASHING CLOTHES

[75] Inventor: Clark I. Platt, Benton Harbor, Mich.

[73] Assignee: Whirlpool Corporation, Benton Harbor, Mich.

[22] Filed: May 15, 1975

[21] Appl. No.: 577,884

Related U.S. Application Data

[62] Division of Ser. No. 418,378, Nov. 23, 1973, abandoned.

[52] U.S. Cl. ..... 8/159

[51] Int. Cl.[2] ..... D06F 13/00

[58] Field of Search ..... 8/159; 68/131–134, 68/28, 38, 53, 54, 89, 184, 23.6, 23.7

[56] References Cited

UNITED STATES PATENTS

| | | | |
|---|---|---|---|
| 1,704,932 | 3/1929 | Altorfer | 68/133 |
| 1,834,936 | 12/1931 | Bryant | 68/133 |
| 1,923,580 | 8/1933 | Nelson | 8/159 |
| 2,021,097 | 11/1935 | Maus | 68/133 |
| 2,253,989 | 8/1941 | Skinner | 68/54 X |
| 2,331,897 | 10/1943 | Dyer | 68/23.7 X |
| 2,502,702 | 4/1950 | Castner | 68/134 |
| 2,734,367 | 2/1956 | Geldhof | 68/133 |
| 3,117,434 | 1/1964 | Byrd et al. | 68/134 |
| 3,285,040 | 11/1966 | Bochan | 68/134 |
| 3,464,239 | 9/1969 | Hubbard et al. | 68/134 |
| 3,678,714 | 7/1972 | Krolzick | 68/131 |
| D196,194 | 9/1963 | Krolzick | D49/1 |

*Primary Examiner*—Philip R. Coe

[57] ABSTRACT

Improved method for operating an automatic clothes washing machine of the type in which an agitator is oscillated by means of a drive mechanism to secure agitation of the clothes. The present invention provides a method wherein the clothes are immersed in a receptacle containing a washing liquid, the clothes are subjected to agitation with scrubbing action in a lower portion of the receptacle by means of the aforementioned agitator under conditions sufficient to force the clothes radially outwardly toward the perimeter of the receptacle, upwardly toward the top of the receptacle and then radially inwardly. The clothes are intermittently forced downwardly by an augering action which directs the clothes to the zone of agitation with scrubbing action. The clothes are thus subjected to numerous rollover cycles in passing through the washing liquid, thereby ensuring positive washing action.

12 Claims, 4 Drawing Figures

METHOD OF WASHING CLOTHES

REFERENCE TO RELATED APPLICATION

This application is a division of my copending application Ser. No. 418,378 filed Nov. 23, 1973, and now abandoned.

BACKGROUND OF THE INVENTION

1. Field of the Invention

This invention is in the field of clothes washing methods which provide a tumbling motion to the clothes contained within an automatic washing machine and provides a method of efficiently feeding the clothes, particularly large and heavy loads into the zone of the washing machine wherein effective washing contact and cooperation with the oscillatory agitator takes place.

2. Description of the Prior Art

It has long been appreciated that the most efficient clothes movement pattern for washing clothes within an automatic washing machine having a vertical axis agitator is a pattern which provides a rollover of the clothes which generally involves moving the clothes downward along the agitator barrel, then radially outward from the oscillating agitator vanes, upward along the wall of the tub, and inward toward the barrel. Conventional washing machines are reasonably proficient in achieving this type of rollover pattern when light loads are being washed, but not with heavy loads. When the washing basket is tightly packed with clothes, the load crowds the agitator and the basket area. A conventional oscillating agitator has difficulty in attaining any kind of a rollover of the clothes load under these conditions. The conventional-type agitator then scrubs merely the bottom portion of a tightly-packed heavy load, resulting in a very poor uneven cleaning action.

There are a few examples in prior patents of agitators which include agitator portions which move in separate paths during a washing operation. For example, the Bryant U.S. Pat. No. 1,834,936 suggests dual agitator members which are reciprocated in opposite directions within the tub, the object being to create a violent water action.

The Krolzick U.S. Pat. No. 3,678,714 assigned to the same assignee as the present invention describes a washing machine assembly including a pair of agitators, the two agitators being coupled together for mutual oscillation, but having cam means or the like provided between the two agitators to effect a vertical reciprocation of one with respect to the other during such oscillation.

Prior art patents disclose agitators with spiral vane elements. For example, Dyer U.S. Pat. No. 2,331,897 discloses a washing machine having an agitator provided with a spiral vane on an upper portion, the agitator rotating at motor speed during washing.

Krolzick U.S. Pat. No. Des. 196,194 assigned to the same assignee as the present invention shows an agitator for a laundry machine wherein the ornamental design for the agitator includes a spiral vane arrangement.

Geldhof U.S. Pat. No. 2,734,367, assignee to a predecessor of the assignee of the present invention, shows an agitator for a laundry machine wherein the agitator includes spiral vanes which extend in the form of radial vanes on their lower edges with radial projections or vanes extending intermediate the spiral vanes.

SUMMARY OF THE INVENTION

The present invention provides an improved method for use with an automatic washer having a clothes washing receptacle and drive means for driving an agitator in an oscillatory fashion. In the lower portion of the clothes washing receptacle, the clothes are subjected to agitation and scrubbing action by the oscillating main agitator element. A feeding means in the form of an auger-like helical vane which is mounted on the same shaft as the main agitator means, and which is driven via a one way clutch, feeds or augers the clothes downwardly toward the main agitator element. The clothes are thus fed downwardly centrally of the receptacle where they come under the influence of the oscillating vertically positioned vanes of the lower agitator element which subjects the clothes to a scrubbing action and directs them radially outwardly toward the periphery of the receptacle, and eventually upwardly and back to the zone where the auger-like vane means feed the clothes back to the lower agitator element. The result is a repeating rollover cycle which is extremely efficient for securing a uniform scrubbing contact of the clothes or fabrics undergoing washing within the wash liquid.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of theh disclosure, and in which.

DESCRIPTION OF THE PREFERRED EMBODIMENTS

Figure 1:
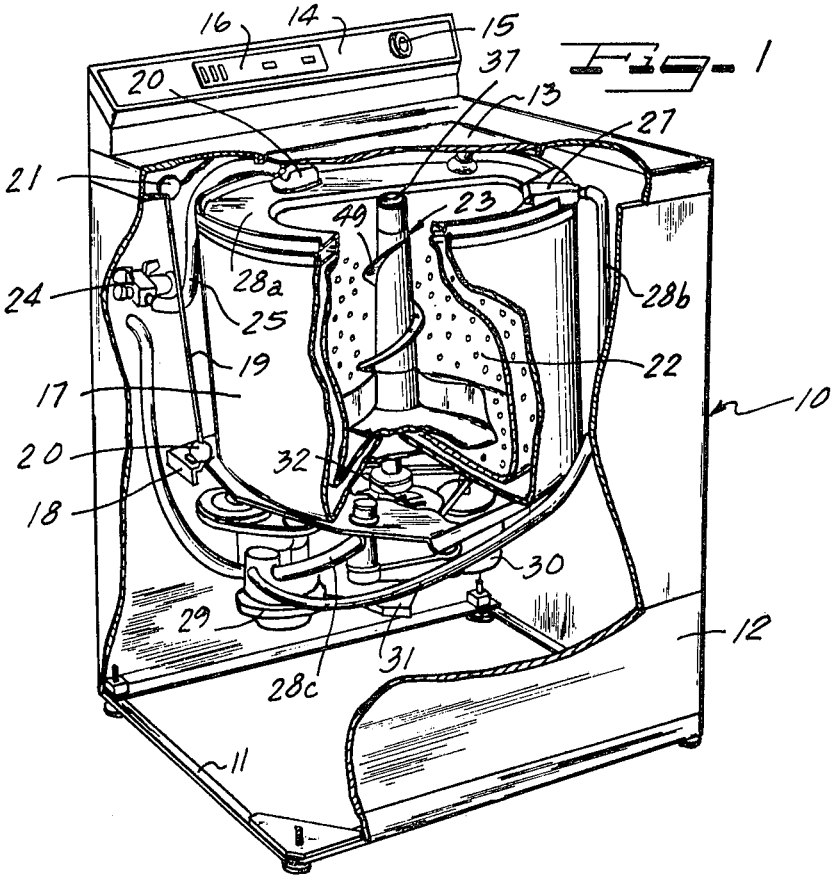
FIG. 1 is a view partly broken away, of a conventional automatic washing machine assembly provided with an improved agitator means according to the present invention.

In FIG. 1, reference numeral 10 indicates generally a washing machine of the automatic type including a frame 11 carrying vertical panels 12 forming the sides, front and back of the machine. A hinged lid 13 is provided in the usual manner to provide access to the interior of the washing machine. The washing machine 10 has the usual console 14 including a timer dial 15 and a program selector 16.

Internally of the machine there is disclosed an imperforate tub 17 which is supported within the cabinet by means of a base support plate 18. A plurality of suspension rods 19 having resilient spherical end portions 20 and 21 are positioned about the tub 17 in the usual manner to suspend the tub freely within the interior of the cabinet.

A perforate washing receptacle or basket 22 is positioned concentrically with the tub 17. Centrally of the perforate washing basket 22 is an improved agitator means which has been designated generally in the drawings at reference numeral 23.

After the clothes and fabrics to be washed are placed or loaded into the washing receptacle, liquid is introduced into the washing machine by means of a solenoid controlled inlet valve 24 which directs the liquid through a conduit 25 and through an anti-siphon device 26 into the washing area where the clothes and fabrics are immersed in the washing liquid. A filter 27 is positioned along a tub ring 28*a* disposed between the tub 17 and the basket 22. A conduit 28*b* connects the outlet port of a pump 29 to the filter 27, and a second conduit 28*c* provides fluid communication between the inlet port of pump 29 and the clothes washing area of the washing machine. During the agitate portion of the wash cycle wash water is circulated by the pump 29 through conduit 28*b* to filter 27, from the filter into the washing area, and from the washing area through a second conduit 28*c* back to the pump. A filtering of the wash water is thus accomplished.

The pump as well as the other movable parts of the assembly are driven by means of a motor 30 which operates through a transmission 31. A clutch and brake assembly generally indicated at reference numeral 32 is provided for energizing the agitator means 23 during washing, and for disengaging the agitator and engaging a spin tube, subsequently to be described, for spinning the basket 22 during the liquid extracting portion of the washing phase. All of the drive elements and hydraulic units described thus far are conventional in vertical-axis automatic washing machines, and the improvements of the present invention are centered in the agitator means 23, which is described specifically below.

Figure 2:
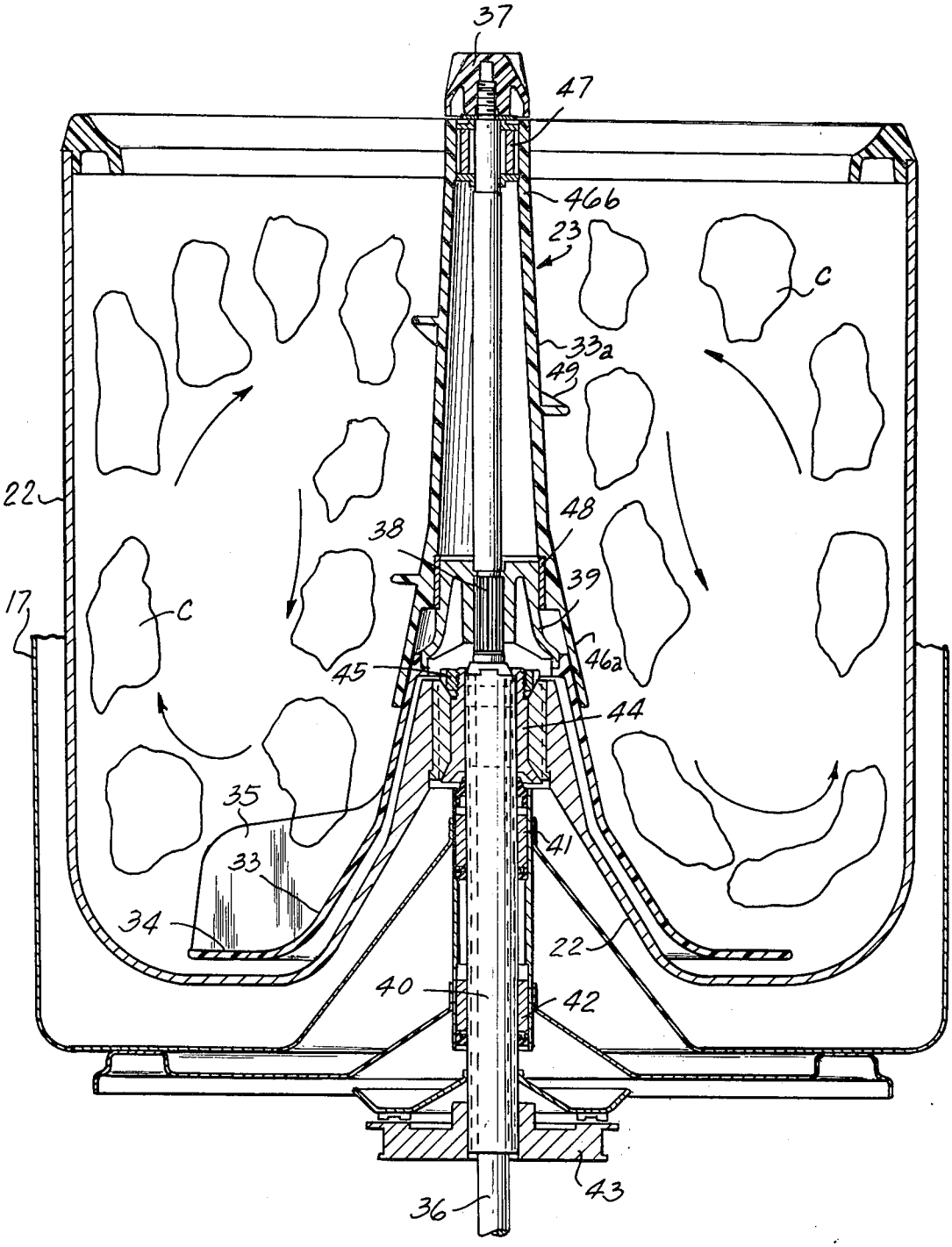
FIG. 2 is a vertical cross-sectional view of the improved agitator means of the present invention during a washing cycle showing the manner in which the clothes are rolled over to ensure efficient contact with the wash liquid.

As seen in FIG. 2, the agitator means 23 has a lower agitator element 33 with a skirt portion 34 which carries a plurality of spaced, generally vertical agitator vanes 35. An agitator drive shaft 36 extends through the lower agitator element 33 and an upper agitator element 33*a* and is threadedly received within an agitator cap 37. The shaft 36 has a splined portion 38 which is rigidly connected to an agitator drive coupler 39 for oscillating the lower agitator element 33 in the usual manner.

A spin tube 40 surrounds the shaft 36 over a portion of its length and is received between spaced bearings 41 and 42. A pulley 43 is provided about the spin tube 40 for mechanical connection to a drive motor and transmission in the usual manner. The upper end of the spin tube 40 is received within a basket drive block 44 and its associated nut 45 to drive the basket 22 at high speed during the extraction cycle when wash liquid is removed from the clothes by centrifugal force.

Figure 3:
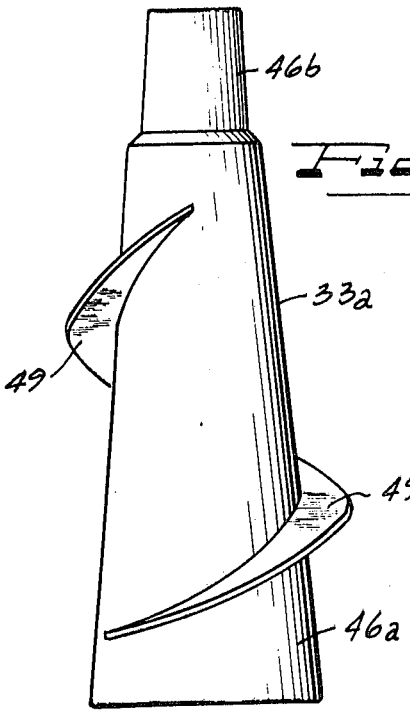
FIG. 3 is a view in elevation of the upper agitator element shown in the assembly of FIG. 2.

The upper agitator element 33*a* is composed of a synthetic resin or the like and, as illustrated in FIGS. 2 and 3 is hollow and has a larger-diameter end portion 46*a* in the area adjacent to the lower agitator element 33, and a smaller-diameter upper portion 46*b* at the upper end thereof. As best illustrated in FIG. 2, the lower end of the upper agitator element 33*a* is received in overlapping relationship with the upper portion of the lower agitator element 33. The agitator drive shaft 36 extends up through the upper agitator element 33*a* and is mechanically coupled thereto through a one-way drive mechanism such as a one-way clutch 47 (which may be for example, a Torrington positive grip one-way roller clutch model RCB-101416) located at the upper end of the shaft 36. A sleeve bearing 48 provides for relative rotation between the lower agitator element 33 and the upper agitator element 33*a*.

The outer periphery of the upper agitator element 33*a* is provided with vane means 49 for urging clothes downwardly. A continuous helical vane 49 is shown extending outwardly from the conical wall of the upper agitator element 33*a* down the length of the upper agitator element 33*a* and terminating short of the vertical agitator vanes 35 for urging or deflecting clothes downwardly. With the arrangement shown, the upper agitator element 33*a* is positively driven through one-way clutch 47 only when the agitator drive shaft 36 is moved in a counterclockwise direction. Under very light loads the upper agitator element will tend to oscillate with the lower agitator element 33. However, under a full clothes load, when the agitator drive shaft 36 moves in a clockwise direction, the one-way clutch 47 allows the upper agitator element to remain relatively stationary due to the frictional drag placed thereon by the water and clothes within the basket. Thus there is substantially automatic sensing of the magnitude of the clothes load to provide incremental rotation under large or full load conditions. This incremental or intermittent rotation of the upper agitator element 33*a* with a large clothes load is thus a single direction pulsating movement which provides a double action agitator and causes the helical vane 49 to act as an auger and thus auger or urge the clothes identified at reference numeral C downwardly along the upper agitator element into the oscillating vertical agitator vanes 35 which move the clothes out radially toward the periphery of the basket 22, thence upwardly and inwardly toward the upper agitator element 33*a*, all as indicated by the arrows shown in FIG. 2 of the drawings. This creates a highly desirable generally toroidal rollover movement or action which subjects the clothes to intimate contact with the washing liquid and to effective scrubbing action from the lower agitator element. (In FIG. 2, the washing liquid has been omitted, and only a partial clothes load has been illustrated for purposes of clarity).

Figure 4:
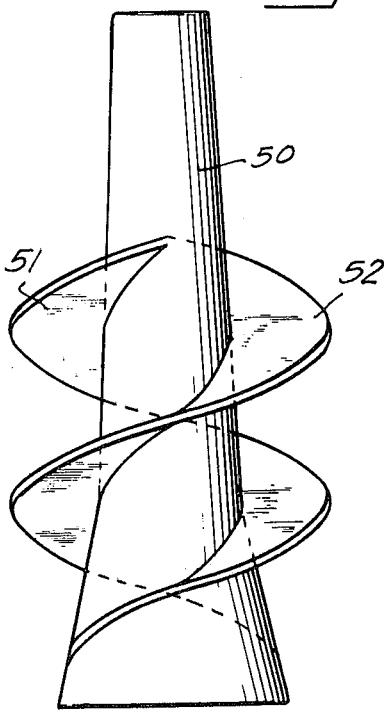
FIG. 4 is an elevational view of a modified form of upper agitator element which can be used for the purposes of the present invention.

A modified form of upper agitator element 50 for use in the present invention is illustrated in FIG. 4 of the drawings. This figure illustrates an upper agitator element 50 having two helical vanes 51 and 52 each having a pitch differing somewhat from the pitch of the helical vane 49 shown in detail in FIG. 3 which advantageously may have (1¼) turns over the length of upper agitator element 33*a*. The pitch of these helical vanes affects the rate at which clothes are moved down along the upper agitator element with a greater pitch increasing the rate.

From the foregoing, it will be seen that the present invention provides an agitator means having a lower agitator element mounted for oscillating motion about an axis and an upper agitator element mounted for unidirectional rotation about the same axis, the upper agitator element having means associated therewith for urging clothes adjacent the upper portion down to the lower portion of the agitator means. This type of double action or dual agitator especially improves the washing action of heavy loads of clothes because the unidirectional upper portion urges the clothes down to the oscillating lower portion for positive rollover and washing action. Thus the present invention for positive rollover means for effectively washing a relatively large clothes load with a given amount of washing liquid thereby permitting economies in water usage, detergent usage, and power usage for heating the washing liquid. The agitator means provides good washing action for both light and heavy loads, with the oscillating lower portion providing most of the action on the light loads. In addition the agitator means is simple and easy to construct and can be accommodated on conventional drive shaft constructions. Furthermore, the pitch of vanes associated with the agitator means can be varied to change the downward movement of the clothes during agitation, thereby making the agitator means more readily adaptable to various sizes and shapes of baskets.

It should be evident that various modifications can be made to the described embodiments without departing from the scope of the present invention.

The embodiments of the invention in which an exclusive property or privilege is claimed are defined as follows:

1. The method of washing clothes by subjecting them to a substantially continuous rollover movement pattern in a clothes washer comprising:

placing the clothes in a receptacle in the washer containing a washing liquid, agitating the clothes in the lower portion of the receptacle by applying oscillatory agitation forces to the clothes, scrubbing them and forcing them outwardly from the center of the receptacle, forcing the clothes upwardly towards the top of the receptacle and then inwardly toward its center, and forcing the clothes downwardly towards the lower portion of the receptacle by unidirectionally rotating helically disposed surfaces against said clothes to direct said clothes downwardly in said receptacle, whereby the clothes are subjected to a positive and continuous rollover movement pattern within the receptacle.

2. The method of washing clothes which comprises:

placing said clothes in a receptacle and immersing them in a washing liquid, subjecting said clothes in a lower portion of said receptacle to oscillatory agitation to thereby force said clothes radially outwardly toward the perimeter of said receptacle, upwardly toward the top of said liquid, and then radially inwardly, and thereafter intermittently forcing the clothes downwardly with a single direction pulsating movement to direct the clothes to said oscillatory agitation.

3. The method of claim 2 in which said clothes are scrubbed during said oscillatory agitation.

4. The method of claim 2 in which said pulsating movement is commenced after a predetermined frictional drag is exceeded.

5. The method of claim 2 in which said pulsating movement provides an augering action on the clothes.

6. The method of operating a washing machine which comprises:

placing a load of clothes to be washed in a receptacle in the machine, immersing the load of clothes in a washing liquid contained in the receptacle, oscillating a first vaned agitator element near the base of said receptacle to scrub the clothes and propel them radially outwardly toward the perimeter of said receptacle, upwardly toward the surface of said liquid and radially inwardly toward the center of said receptacle, and augering the clothes centrally of said receptacle by unidirectionally rotating a second vaned agitator element to force the clothes downwardly toward said first vaned agitator element.

7. The method of claim 6 in which the augering is commenced after a sufficiently large load of clothes is present in said receptacle.

8. A method of washing clothes comprising the steps of:

placing the clothes in a receptacle, adding washing liquid to the receptacle, and continuously feeding clothes from the upper center region of the receptacle downwardly by use of a unidirectionally rotating auger to the lower center region of the receptacle while continuously scrubbing clothes in the lower region of the receptacle and moving them outwardly through said lower region by use of an oscillating agitator element, said feeding of said clothes downwardly and said moving of said clothes outwardly creating a circulation pattern of clothes movement within said receptacle which continuously carries clothes from the lower outer region to the upper center region of said receptacle.

9. A method according to claim 8 wherein the step of feeding the clothes downwardly by unidirectionally rotating an auger utilizes at least one helical vane which is rotated in the center region of the receptacle to drive clothes adjacent said vane downwardly by contacting them with said vane.

10. A method of washing fabric in an automatic washer having a receptacle containing an agitator including a vaned upper barrel portion and a lower skirt portion, said method comprising the steps of:

placing the clothes in said receptacle, adding washing liquid to said receptacle, treating the fabric by unidirectionally rotating said barrel portion of said agitator to feed fabric from the upper center region of said receptacle downwardly by contacting the fabric with the vanes of said barrel portion to the lower center region of saiad receptacle, and oscillating said skirt portion of said agitator to scrub fabric in said lower region of said receptacle and move the fabric outwardly through said lower region, said feeding of said fabric downwardly and said moving of said fabric outwardly creating a substantially continuous rollover pattern of fabric movement within said receptacle which carries fabric from the lower outer region to said upper center region of said receptacle.

11. A method according to claim 10 wherein the step of unidirectionally rotating said barrel portion of said agitator includes rotating said barrel portion in distinct increments corresponding to the oscillations of said skirt portion.

12. A method of washing clothes in an automatic washer having a receptacle and an agitator centrally located within said receptacle including a distinct upper agitator element, said method comprising the steps of:

placing clothes in said receptacle, adding washing liquid to said receptacle, oscillating said agitator to scrub clothes in the lower region of said receptacle and move them outwardly through said region, and limiting movement of said upper agitator element to unidirectional rotation in response to substantial contact between said upper agitator element and clothes adjacent thereto, and augering clothes adjacent said upper agitator element downwardly along said element to said lower region of said receptacle in response to said unidirectional rotation.

* * * * *